US007798351B2

(12) United States Patent
Voss

(10) Patent No.: US 7,798,351 B2
(45) Date of Patent: Sep. 21, 2010

(54) BOX-LIKE CONTAINER FOR TRANSPORTING HOUSEHOLD ITEMS WHICH ALSO MAY BE USED TO CREATE PIECES OF FURNITURE

(76) Inventor: Sarah H. Voss, 685 N. 59th St., Omaha, NE (US) 68132

( * ) Notice: Subject to any disclaimer, the term of this patent is extended or adjusted under 35 U.S.C. 154(b) by 233 days.

(21) Appl. No.: 12/074,591

(22) Filed: Mar. 5, 2008

(65) Prior Publication Data

US 2008/0223738 A1 Sep. 18, 2008

Related U.S. Application Data

(60) Provisional application No. 60/906,561, filed on Mar. 13, 2007.

(51) Int. Cl.
*B65D 85/00* (2006.01)

(52) U.S. Cl. ..... 217/12 R; 206/45.2; 312/241

(58) Field of Classification Search ..... 206/45.2, 206/45.21, 45.22, 45.24, 45.25, 736, 576, 206/577; 108/14, 25, 115, 127; 190/11, 190/12 R, 12 A; 217/12 R, 13, 36, 43 R, 217/45; 294/119; 312/240, 241
See application file for complete search history.

(56) References Cited

U.S. PATENT DOCUMENTS

| | | | | | |
|---|---|---|---|---|---|
| 2,258,364 | A * | 10/1941 | Maxwell | 190/11 |
| 2,709,020 | A * | 5/1955 | Ladd | 217/12 R |
| 2,728,478 | A * | 12/1955 | Haner | 217/12 R |
| 4,231,453 | A * | 11/1980 | Minor | 190/11 |
| 4,692,119 | A * | 9/1987 | Ussery | 217/12 R |
| 4,867,327 | A * | 9/1989 | Roland | 217/12 R |
| 7,278,537 | B2 * | 10/2007 | Lown et al. | 206/45.24 |

* cited by examiner

*Primary Examiner*—Luan K Bui
(74) *Attorney, Agent, or Firm*—Dennis L. Thomte; Thomte Patent Law Office LLC

(57) ABSTRACT

This invention relates to an over-sized box-like container adapted to carry diverse, and often collapsed or unassembled household items, including furniture, accessories and art objects suitable to fully furnish one room. More particularly, this invention relates to an over-sized box-like container of the type described where the box itself, upon being disassembled, may be used to create one or more pieces of furniture.

15 Claims, 7 Drawing Sheets

BOX-LIKE CONTAINER FOR TRANSPORTING HOUSEHOLD ITEMS WHICH ALSO MAY BE USED TO CREATE PIECES OF FURNITURE

CROSS REFERENCE TO RELATED APPLICATION

This Application claims the benefit of Provisional Application 60/906,561 filed Mar. 13, 2007 entitled ROOMS IN BOXES.

BACKGROUND OF INVENTION

1. Field of Invention

This invention relates to an over-sized box-like container adapted to carry diverse, and often collapsed or unassembled household items, including furniture, accessories and art objects suitable to fully furnish one room. More particularly, this invention relates to an over-sized box-like container of the type described where the box itself, upon being disassembled, may be used to create one or more pieces of furniture.

2. Background of the Invention

In once sense, the instant invention is an elaboration of what might be termed as "camp" box, where gear is packed in a container sufficient to set up "camp." However, the conventional "camp" boxes are not convertible into pieces of furniture.

Many persons who are just starting out in apartment dwelling or home living have limited assets to furnish an apartment or home. Further, the apartment dweller or new home purchaser will have difficulty in accumulating sufficient furniture to decorate the apartment or home.

The target audience for the instant invention would be a student; a parent wanting to purchase a great gift for a young couple just starting out; a young couple just starting out minus gift-bearing parents; a professional of any age who moves frequently; someone furnishing a secondary residence; a business company providing temporary quarters for an employee; a clever builder wanting to give his "model" homes a catchy twist; anyone wishing to simplify or downsize or start anew; FEMA or its counterpart.

SUMMARY OF THE INVENTION

A box-like container is disclosed for carrying diverse household items and which is capable of being disassembled for use as components of furniture comprising a rectangular bottom, having first and second end edges, first and second side edges, an upper surface and a lower surface. A first upstanding square-shaped end wall, having upper and lower end edges, first and second side edges, an inner surface and an outer surface, is provided with the lower end edge of the first end wall being positioned on the upper surface of the bottom at the first end edge thereof and extending upwardly therefrom. A second upstanding square-shaped end wall, having upper and lower end edges, first and second side edges, an inner surface and an outer surface is also provided. The lower end edge of the second end wall is positioned on the upper surface of the bottom at the second end edge thereof and extends upwardly therefrom.

A first rectangular side wall having upper and lower end edges, first and second end edges, an inner surface and an outer surface is also a part of the container. The inner surface of the lower end edge of the first side wall is positioned at the first side edge of the bottom. The lower end edge of the first side wall is selectively removably secured to the first side edge of the bottom. The inner surface of the first end edge of the first side wall is positioned adjacent the first side edge of the first end wall. The end edge of the first side wall is selectively removably secured to the first side edge of the first end wall. The inner surface of the second end edge of the first side wall is positioned adjacent the first side edge of the second end wall and the second end edge of the first side wall is selectively removably secured to the first side edge of the second end wall.

The container also includes a second upstanding rectangular side wall having upper and lower end edges, first and second end edges, an inner surface and an outer surface. The inner surface of the lower end edge of the second side wall is positioned at the second side edge of the bottom. The lower end edge of the second side wall is selectively removably secured to the second side edge of the bottom. The first end edge of the second side wall is selectively removably secured to the second side edge of the first end wall. The second end edge of the second side wall is selectively removably secured to the second side edge of the second end wall.

The container also includes a third upstanding side wall having upper and lower end edges, first and second end edges, an inner surface and an outer surface. The lower end edge of the third side wall is positioned adjacent the upper end edge of the second side wall. The inner surface of the first end edge of the third side wall is positioned adjacent the second side edge of the first end wall. The first end edge of the third side wall is selectively removably secured to the second side edge of the first end wall. The inner surface of the second end edge of the third side wall is positioned adjacent the second side edge of the second end wall and the second end edge of the third side wall and is selectively removably secured to the second side edge of the second end wall.

The container may also include an optional rectangular fourth side wall or gusset which is selectively removably positioned at the outer surfaces of the second and third side wall members with the fourth side wall having an upper end edge, a lower end edge, a first end edge and a second end edge wherein the first end edge of the fourth side wall is selectively removably secured to the first end edges of said second and third side walls and to said second side edge of the first end wall and wherein the second end edge of the fourth side wall is selectively removably secured to the second end edges of the second and third side walls and to the second side edge of the second end wall.

A rectangular-shaped top is positioned on the upper end edges of the first and second end walls and extends therebetween between upper end edges of the first side wall and the third side wall and is selectively removably secured thereto.

The box-like container contains diverse household items as well as furniture legs which may be secured to base plates or pipe flanges previously secured to the inside surfaces of some of the structural components of the box.

After the container has reached its designation and the contents have been removed therefrom by removing the top from the container, the container may then be completely disassembled with the various components thereof being assembled to create a desk, a bench, a coffee table and an end table. Fasteners in the form of screws which secure the various components of the container together, upon disassembly of the container, may be used to secure components of the container together to create the articles of furniture just described.

A smaller version of the container just described may also be utilized if so desired.

It is therefore a principal object of the invention to provide a container which may include diverse household articles for transport from one location to another and which upon being emptied, may be disassembled to create articles of furniture such as a desk, a bench, a coffee table or an end table, which are joined together and legs or the like secured thereto which are contained within the container.

A further object of the invention is to provide a container of the type described above which makes it extremely convenient for a person who is moving into an apartment, a home, or the like; or one who frequently moves from one location to another.

These and other objects will be apparent to those skilled in the art.

DESCRIPTION OF THE PREFERRED EMBODIMENT

Figure 1:
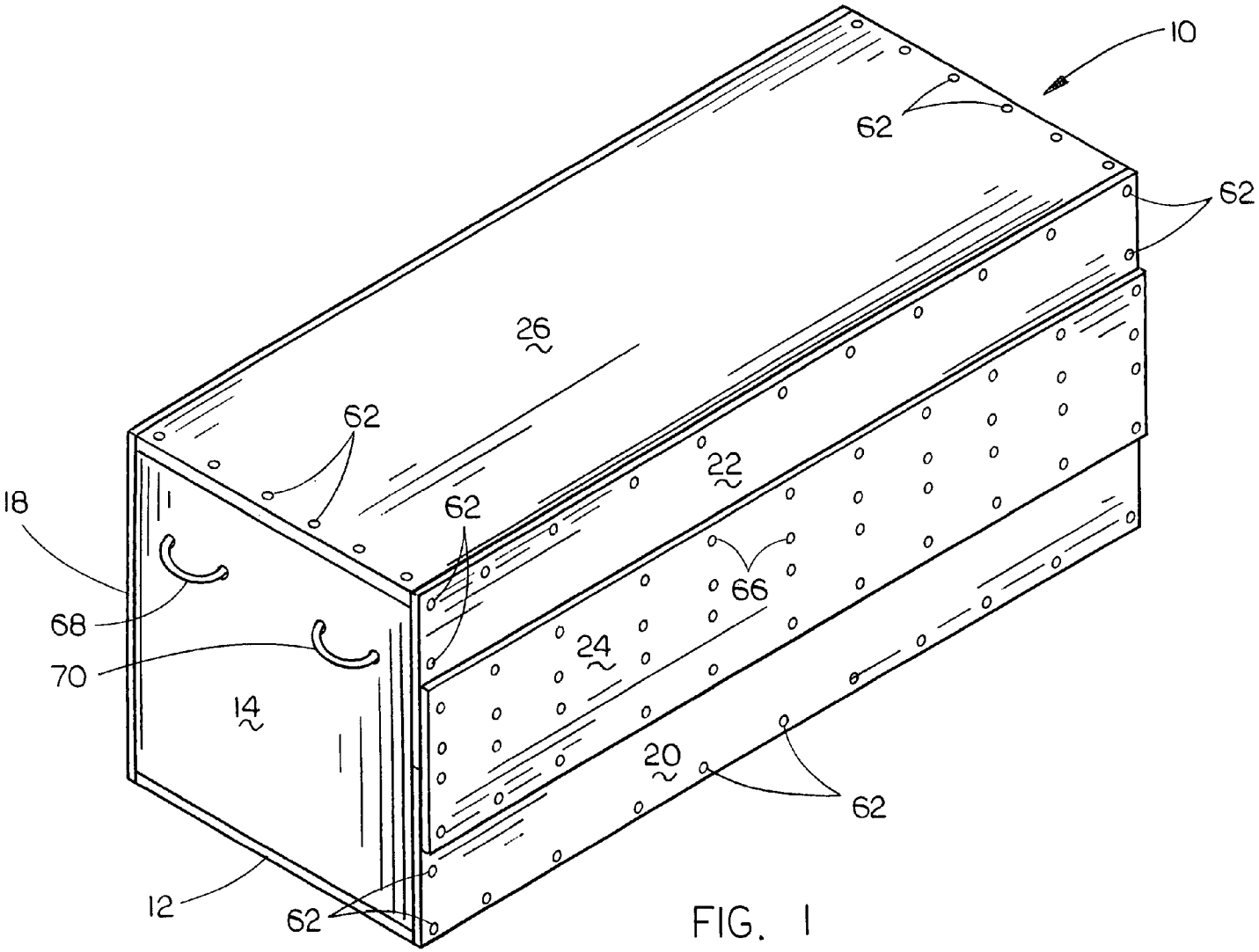
FIG. 1 is a perspective view of the container of this invention.
Figure 2:
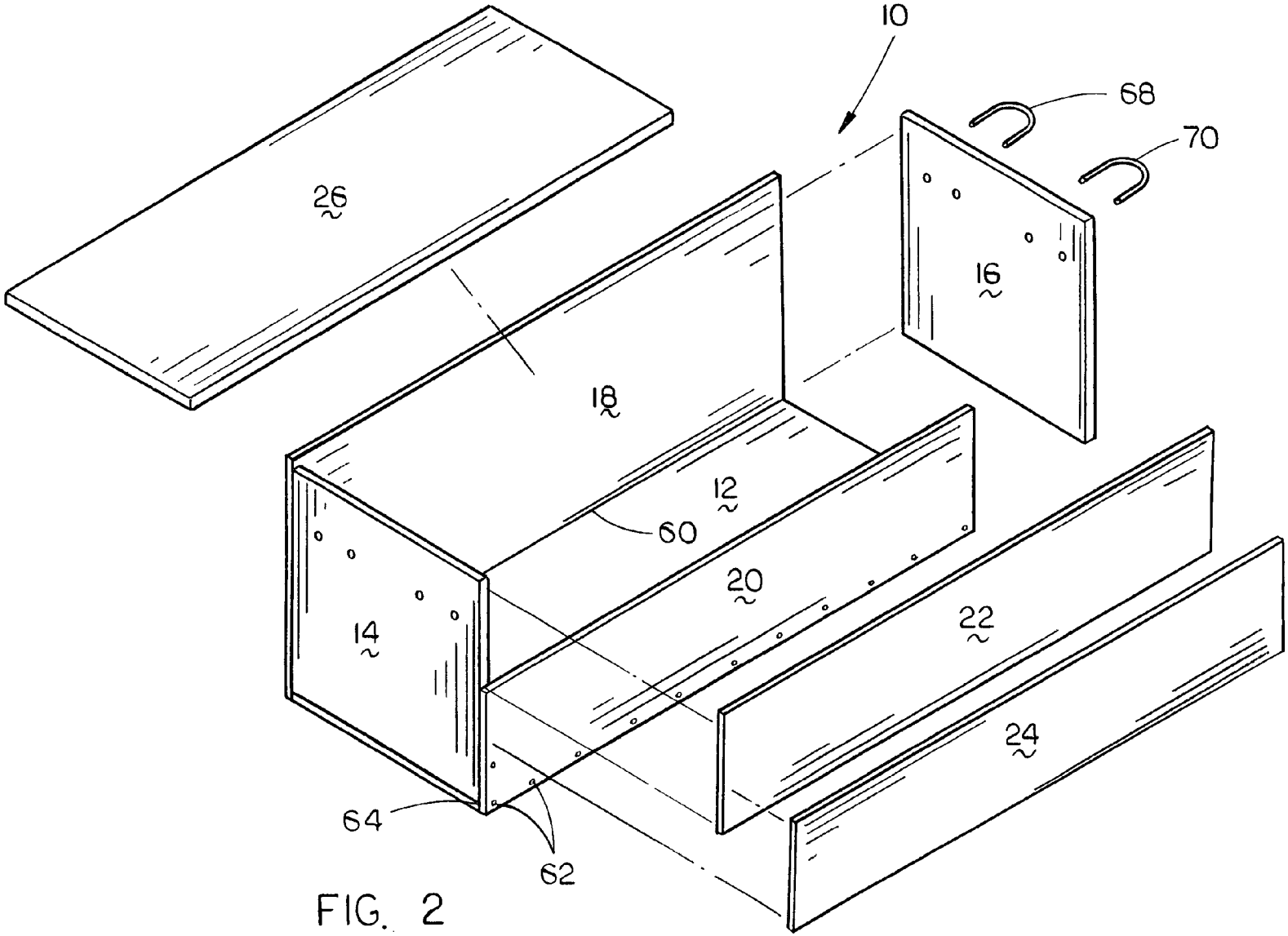
FIG. 2 is a partial exploded perspective view of the container of this invention.
Figures 3, 4, 5:
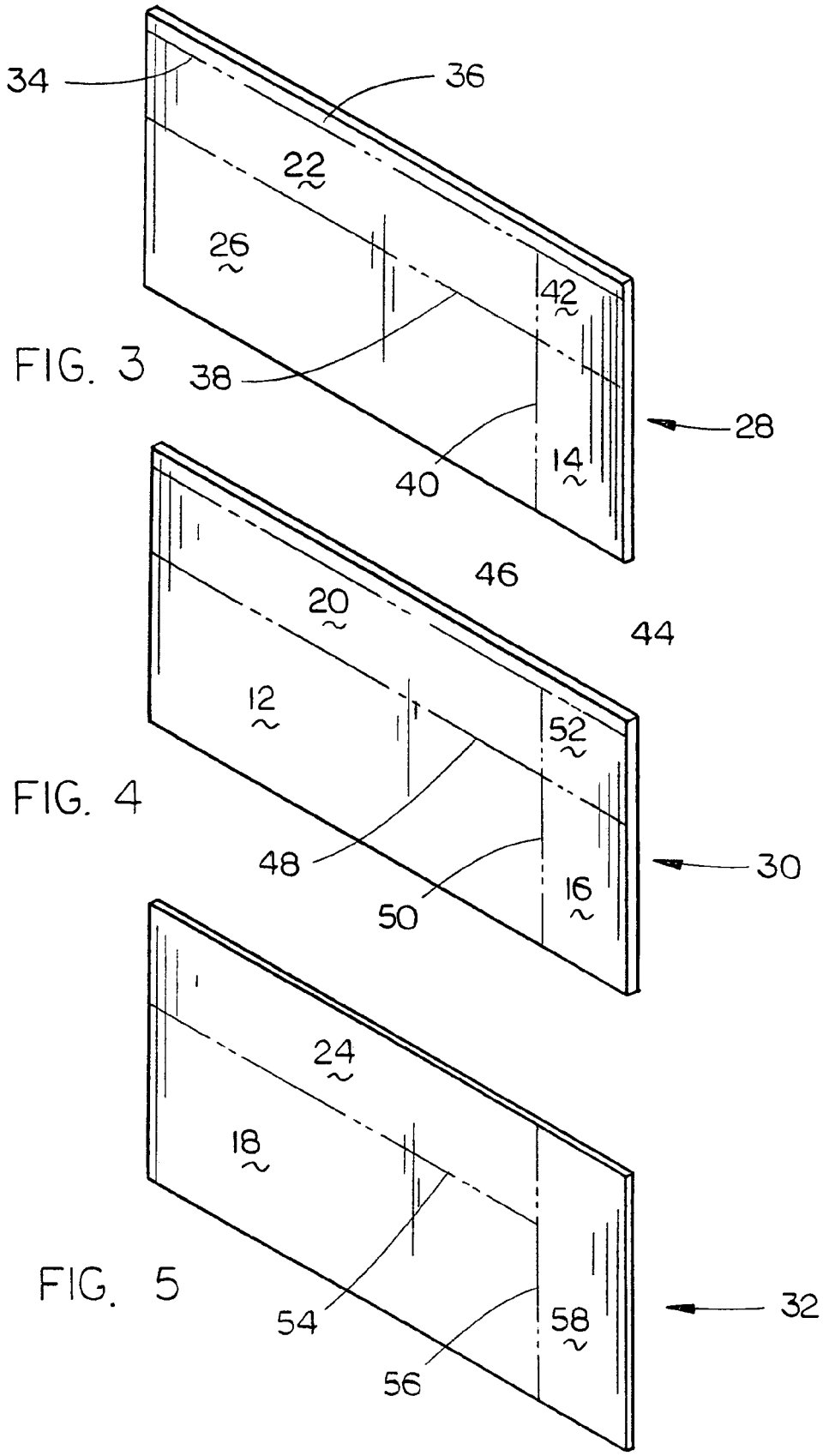
FIGS. 3-5 are perspective views of three 4'×8' plywood sheets which are cut to form the components of the container of FIG. 1.
Figure 6:
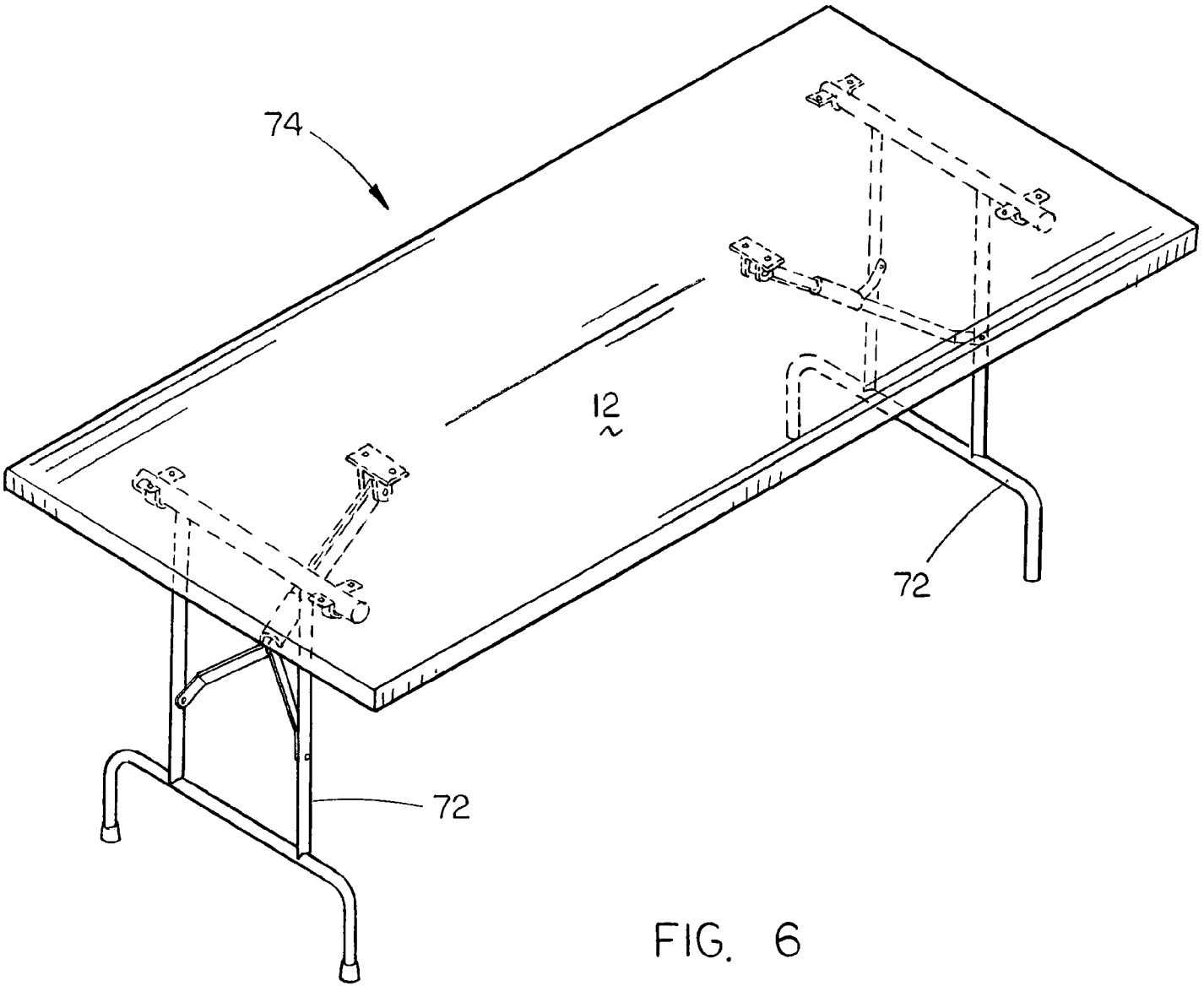
FIG. 6 is a perspective view illustrating a desk top formed from a component of the container with folding legs secured thereto to create a desk.
Figure 7:
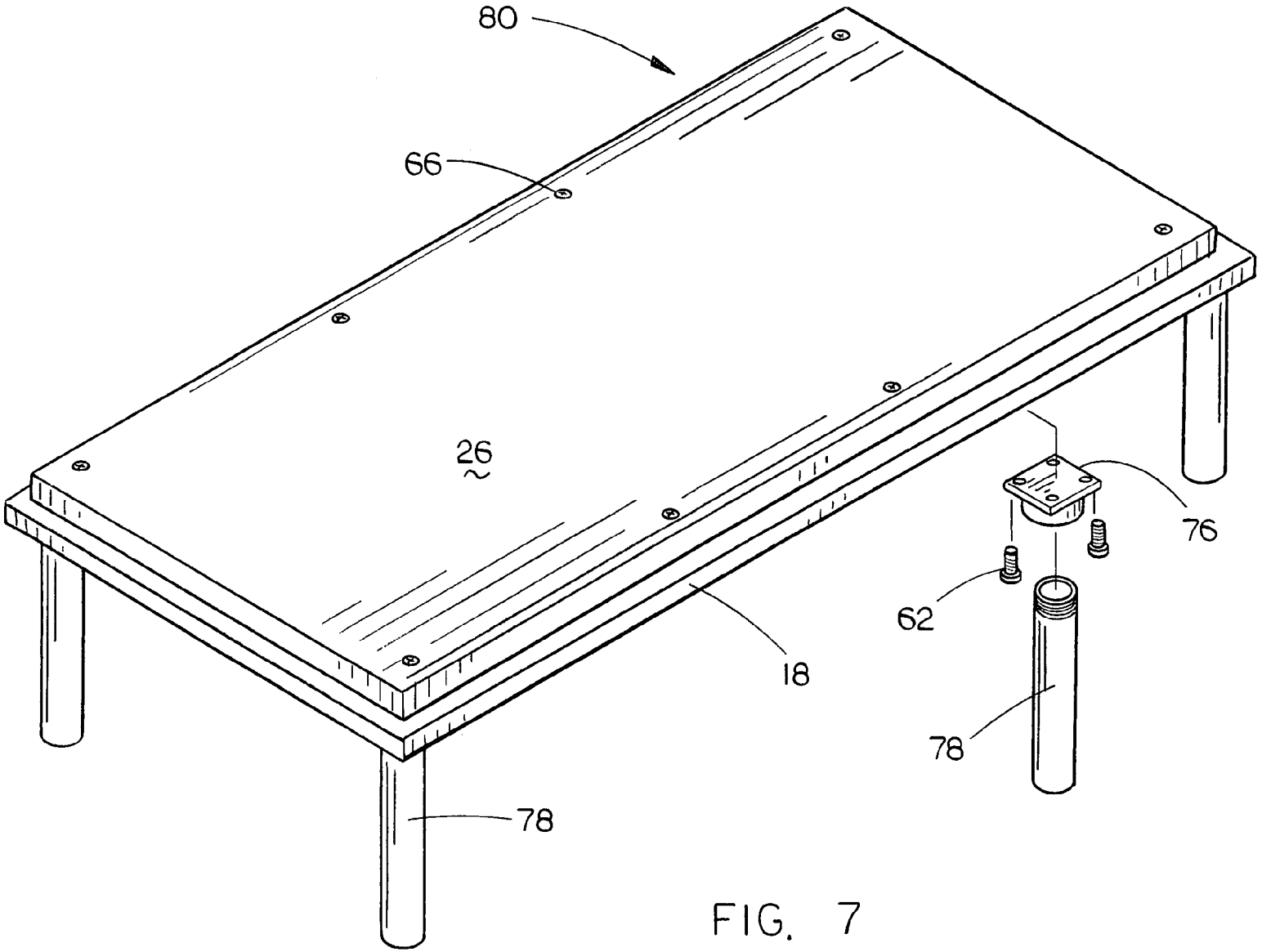
FIG. 7 is a perspective view illustrating a coffee table top formed from components of the container with legs secured thereto to create a coffee table.
Figure 8:
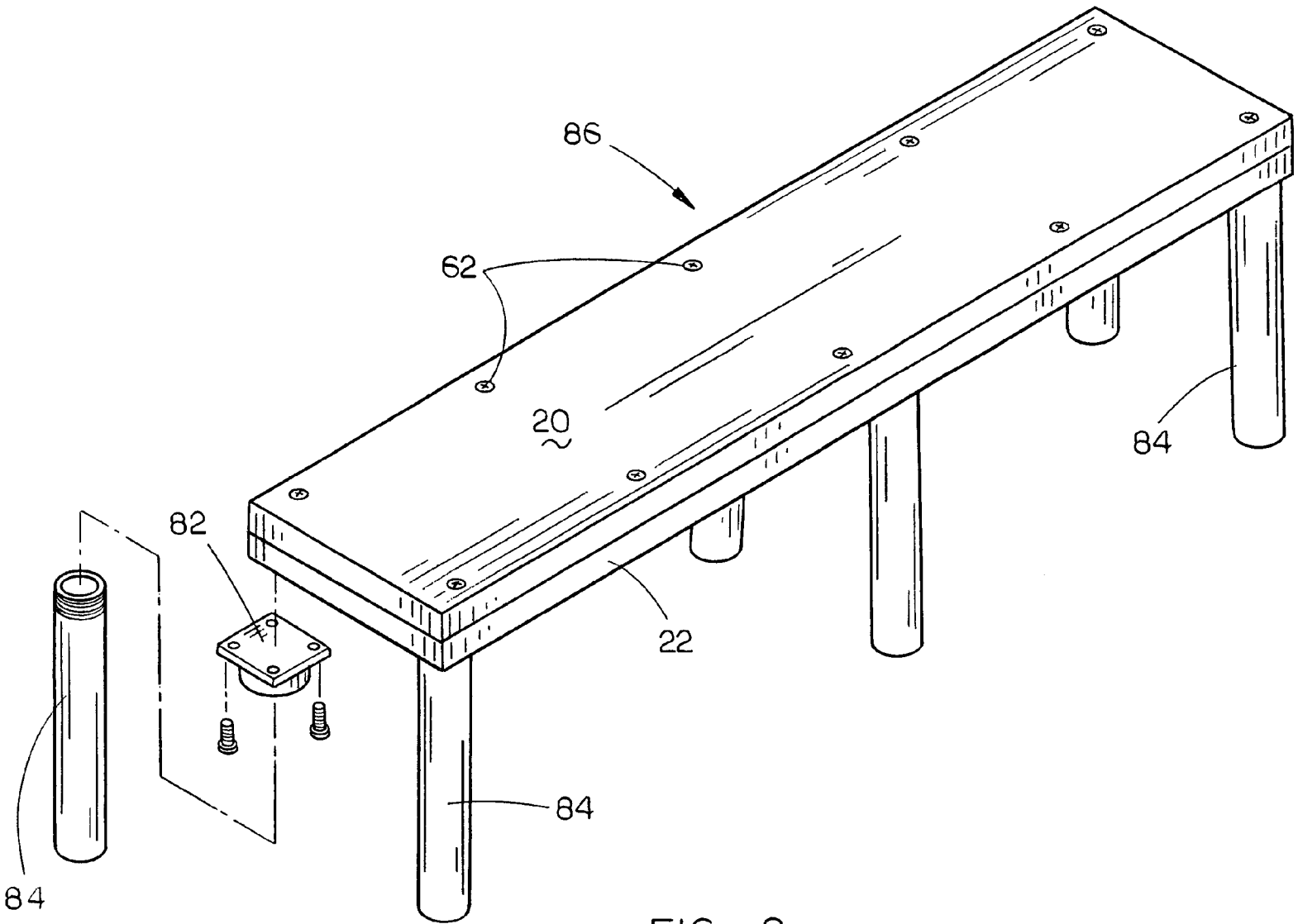
FIG. 8 is a perspective view illustrating a bench top formed from components of the container with legs secured thereto to create a bench.

The container of this invention is referred to generally by the reference numeral 10 and is preferably constructed of plywood or the like. Container 10 includes a bottom 12, end walls 14 and 16, a first side wall 18, a second side wall 20, a third side wall 22, a fourth side wall 24, and a top 26. The just described components are preferably formed from plywood sheets 28, 30 and 32 as seen in FIGS. 3-5. Preferably, sheets 28, 30 and 32 are four feet by eight feet. Preferably, sheets 28 and 30 have a three-fourth inch thickness while sheet 32 has a one-half inch thickness.

Sheet 28 is cut along a line 34 to remove a rectangular waste strip 36 from the sheet 28 which has a width of two and one-quarter inches. Sheet 28 is then cut along lines 38 and 40 to form the third side wall 22, top 26, end wall 14 and a waste portion 42. The third side wall 22 has a dimension of 15¾" by 66" while top 26 has a dimension of 30"×66". End wall 14 has a dimension of 30"×30".

Sheet 30 is cut in the same manner as sheet 28 along line 44 to form waste strip 46 having a width of 2¼". Sheet 30 is cut along lines 48 and 50 to form the second side wall 20 having a dimension of 15¾×66", bottom 12 having a dimension of 30"×66", end wall 16 having a dimension of 30"×30" and waste portion 52.

Sheet 32 is then cut along lines 54 and 56 to form fourth side wall 24 having a dimension of 16½×66", first side wall 18 having a dimension of 31½"×66" and waste portion 58.

If a smaller container than that disclosed herein is to be built, the dimensions described above will be changed.

The container 10 is assembled as follows: Bottom 12 is normally positioned on a flat surface. The first side wall 18 is then positioned so that its lower edge is positioned adjacent the side edge 60 of bottom 12. Drywall screws 62 which are 2" in length are then used to connect the lower end of first side wall 18 to the side edge 60 of bottom 12. The second side wall 20 is then positioned so that its lower edge is positioned adjacent the side edge 64 of bottom 12. Screws 62 are then used to connect the lower edge of side wall 20 to the side edge 64 of bottom 12. End wall 14 is then positioned on bottom 12 between the ends of side walls 18 and 20 with screws 62 being used to secure side walls 18 and 20 to the side edges of end wall 14. End wall 16 is then positioned on bottom 12 between the other ends of side walls 18 and 20 with screws 62 being used to secure side walls 18 and 20 to the side edges of end wall 16.

The third side wall 22 is then placed adjacent the side edges of end walls 14 and 16 so that its lower edge abuts the upper edge of side wall 20. Screws 62 are then used to secure the end edges of side wall 22 to the side edges of end walls 14 and 16. Preferably, the fourth side wall 24 will be used to provide an additional component of furniture to be later assembled but is primarily provided for strengthening purposes. Side wall 24 is positioned at the outer surfaces of side walls 20 and 22 so as to overlap the abutting edges thereof. One inch sheet metal screws 66 are then used to secure side wall 24 to the side walls 20 and 22 and to the side edges of end walls 14 and 16. After the diverse household items and furniture components as described below have been placed in the open container 10, top 26 is positioned on the upper edges of end walls 14 and 16 between the upper inner edges of side walls 18 and 22. Drywall screws 62 are then employed to connect the upper edges of side walls 18 and 22 to the side edges of top 26 and to connect the end edges of top 26 to the upper edges of end walls 14 and 16. Preferably, a pair of rope handles 68 and 70 are provided at each of the end walls 14 and 16 to assist in the carrying of the container.

Items such as: a small couch, chairs, a wine bag, flanges, leg bases, table legs, yardsticks for trim, pipe legs, art paper, slipcovers, pillows, throws, curtains, sheets, tumblers, bowls, lamps, ornaments, table runners, decorative ribbons, picture frames, tablecloth, candles, folding storage box, paper bags, chair pads, artwork, pictures, paintings, photocopies, etc., may be placed within the container 10.

After the container has been transported to its desired location, the container is completely disassembled by removing the screws 62 and 66. At that time, the rope handles 68 and 70 are removed from the end walls 14 and 16.

Prior to the container 10 being assembled, a pair of folding legs 72 are secured to the inner surface of bottom 12. The legs 72 are folded flat against the inner surface of bottom 12 during shipment. When the container 10 is disassembled, the legs 72 are unfolded so that the bottom 12 and the legs 72 form a desk 74.

The top 26 may be secured to side wall 18 by the screws 62 or 66. The edges of the bottom 12 may be finished with yardsticks cut to fit. Prior to the container 10 being assembled, base plates or flanges 76 are secured to the inner surface of side wall 18 by screws such as screws 62 or 66. When the container 10 is disassembled, the legs or pipes 78 are secured to the previously secured base plates or flanges 76 to create a coffee table 80.

Side walls 20 and 22 may be placed one upon the other and screwed together by screws 62 or 66. Prior to the container 10 being assembled, pipe flanges or base plates 82 are secured to the inner surface of side wall 22 by screws such as screws 62 or 66. When the container 10 is disassembled, the pipes or furniture legs 84 are secured to the pipe flanges or base plates 82 to create a bench 86.

Figure 9:
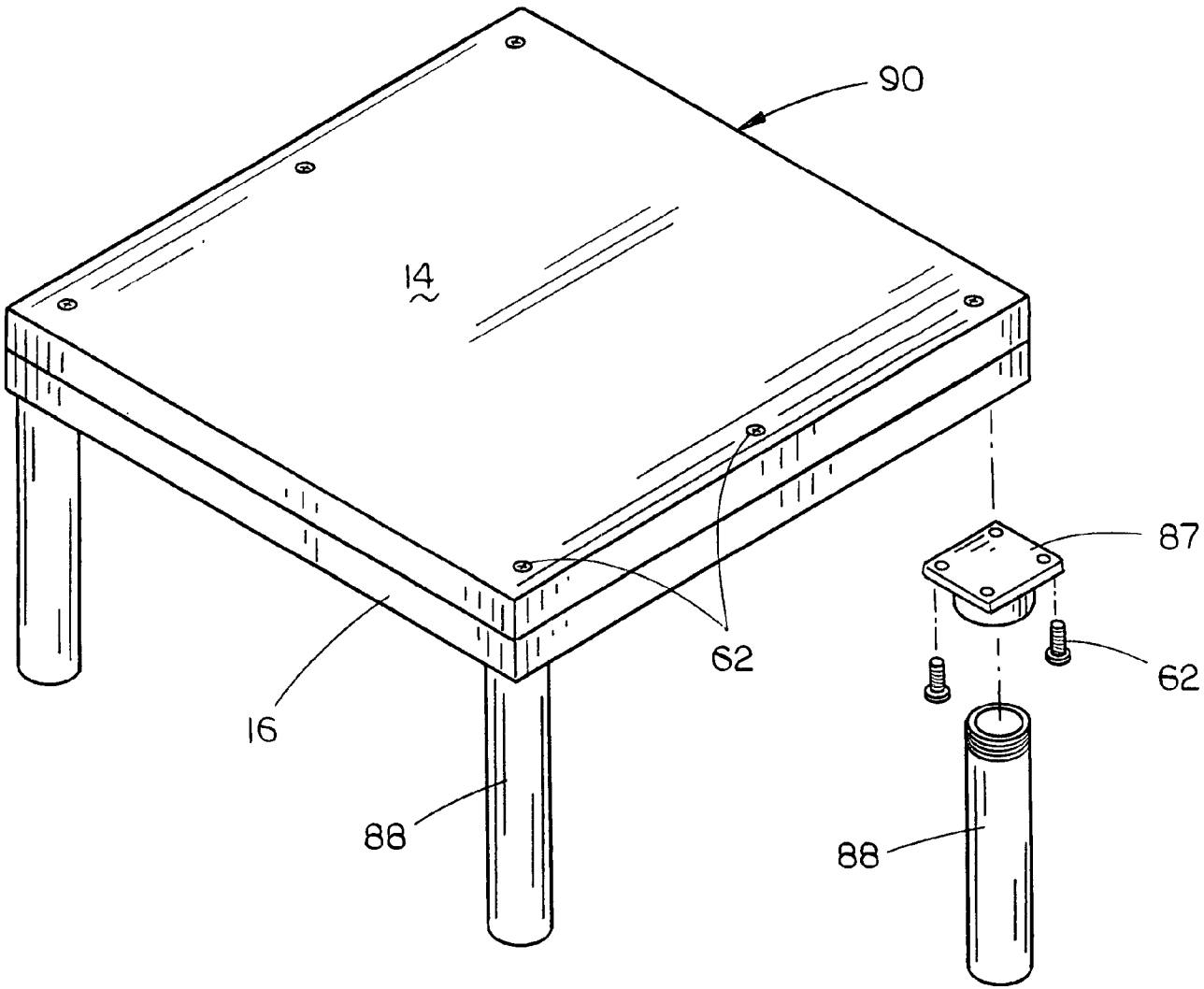
FIG. 9 is a perspective view illustrating an end table top formed from components of the container with legs secured thereto to create a coffee table.

End walls 14 and 16 may be positioned one upon the other as seen in FIG. 9 and secured together by screws 62 or 66. Prior to the container 10 being assembled, base plates or pipe flanges 89 are secured to the inner surface of end wall 16 by screws such as screws 62 or 66. When the container 10 is disassembled, the pipes or furniture legs 88 are attached to the pipe flanges or base plates 89 to create an end table 90.

The desk 74, coffee table 80, bench 86 and end table 90 may then be painted, covered or decorated as desired. The various other diverse household items contained within the container 10 may then be used to decorate the room.

Should the user move, the furniture items may be disassembled and the container reassembled. The various items may then be placed in the container 10 for transport once again.

Thus it can be seen that the invention accomplishes at least all of its stated objectives.

The invention claimed is:

1. A box-like container for carrying diverse household items and which is capable of being disassembled for use as components of furniture, comprising:

a rectangular bottom having first and second ends, first and second sides, an upper surface and a lower surface;

a first upstanding square-shaped end wall having upper and lower ends, first and second sides, an inner surface and an outer surface;

said lower end edge of said first end wall being positioned on said upper surface of said bottom and being selectively removably secured thereto at said first end thereof and extending upwardly therefrom;

a second upstanding square-shaped end wall having upper and lower ends, first and second sides, an inner surface and an outer surface;

said lower end of said second end wall being positioned on said upper surface of said bottom and being selectively removably secured thereto at said second end thereof and extending upwardly therefrom;

a first rectangular upstanding side wall having upper and lower ends, first and second ends, an inner surface and an outer surface;

said inner surface of said lower end of said first side wall being positioned at said first side of said bottom;

said lower end of said first side wall being selectively removably secured to said first side of said bottom;

said inner surface of said first end of said first side wall being positioned adjacent said first side of said first end wall;

said first end of said first side wall being selectively removably secured to said first side of said first end wall;

said inner surface of said second end of said first side wall being positioned adjacent said first side of said second end wall;

said second end of said first side wall being selectively removably secured to said first side of said second end wall;

a second upstanding rectangular side wall having upper and lower ends, first and second ends, an inner surface and an outer surface;

said inner surface of said lower end of said second side wall being positioned at said second side of said bottom;

said lower end of said second side wall being selectively removably secured to said second side of said bottom;

said first end of said second side wall being selectively removably secured to said second side of said first end wall;

said second end of said second side wall being selectively removably secured to said second side of said second end wall;

a third upstanding side wall having upper and lower ends, first and second ends, an inner surface and an outer surface;

said lower end of said third side wall being positioned adjacent said upper end of said second side wall;

said inner surface of said first end of said third side wall being positioned adjacent said second side of said first end wall;

said first end of said third side wall being selectively removably secured to said second side of said first end wall;

said inner surface of said second end of said third side wall being positioned adjacent said second side of said second end wall;

said second end of said third side wall being selectively removably secured to said second side of said second end wall;

a rectangular top having first and second ends, first and second sides, an upper surface and a lower surface;

said top being positioned on said upper ends of said first and second end walls and extending therebetween;

said top extending between said upper inner of said first and third side walls;

said first end of said top being selectively removably secured to said upper end of said first end wall;

said second end of said top being selectively removably secured to said upper end of said second end wall;

said upper end of said first side wall being selectively removably secured to said first side of said top;

said upper end of said third side wall being selectively removably secured to said second side of said top.

2. The container of claim 1 wherein a rectangular fourth side wall is selectively removably positioned at said outer surfaces of said second and third side walls.

3. The container of claim 2 wherein said fourth side wall has an upper end, a lower end, a first end and a second end and wherein said first end of said fourth side wall is selectively removably secured to said first ends of said second and third side walls and to said second side of said first end wall and wherein said second end of said fourth side wall is selectively removably secured to said second ends of said second and third side walls and to said second side of said second end wall.

4. The container of claim 3 wherein said upper end of said fourth side wall is positioned below said upper end of said third side wall and wherein said lower end of said fourth side wall is positioned above said lower end of said second side wall.

5. The container of claim 1 wherein furniture components are removably positioned within the container which may be assembled with certain of the walls of the container when the container has been disassembled.

6. The container of claim 4 wherein said first side wall and said fourth side wall have the same thickness and wherein the thicknesses of said first side wall and said fourth side wall are less than the thicknesses of said second side wall and said third side wall.

7. The container of claim 1 wherein when the container is disassembled, folding legs previously secured to the inner surface of said bottom may be unfolded to create a desk.

8. The container of claim 1 wherein when the container is disassembled, said top and said first side wall member may be screwed together and legs secured thereto to create a coffee table.

9. The container of claim 1 wherein when the container is disassembled, said second and third side walls may be screwed together and legs attached thereto to create a bench.

10. The container of claim 1 wherein when the container is disassembled, said first and said second end walls may be screwed together and legs attached thereto to create an end table.

11. The container of claim 1 wherein upon disassembly of the container: (a) legs may be secured to said bottom to create a desk, (b) said top and said first side wall may be secured together and legs secured thereto to create a coffee table, (c) said second and third side walls may be secured together and legs attached thereto to create a bench, and (d) said first and second end walls may be secured together and legs attached thereto to create an end table.

12. The container of claim 11 wherein the legs for the desk, coffee table, bench and end table are initially included in the items contained within the container.

13. The container of claim 11 wherein the said top and said first side wall are secured together by screws which initially maintain the container in an assembled condition and wherein said second and third side walls are secured together by screws which initially maintain the container in an assembled condition and wherein said first and second end walls are secured together by screws which initially maintain the container in an assembled condition.

14. The container of claim 1 wherein the inner surfaces of certain of said walls have pipe flanges or base plates adapted to have pipes or legs secured thereto or which have folding legs secured thereto.

15. A box-like container for carrying diverse household items and which is capable of being disassembled for use as components of furniture, comprising:

a rectangular bottom having first and second ends, first and second sides, an upper surface and a lower surface;

a first upstanding end wall having upper and lower ends, first and second sides, an inner surface and an outer surface;

said lower end edge of said first end wall being positioned on said upper surface of said bottom and being selectively removably secured thereto at said first end thereof and extending upwardly therefrom;

a second upstanding end wall having upper and lower ends, first and second sides, an inner surface and an outer surface;

said lower end of said second end wall being positioned on said upper surface of said bottom and being selectively removably secured thereto at said second end thereof and extending upwardly therefrom;

a first rectangular upstanding side wall having upper and lower ends, first and second ends, an inner surface and an outer surface;

said inner surface of said lower end of said first side wall being positioned at said first side of said bottom;

said lower end of said first side wall being selectively removably secured to said first side of said bottom;

said inner surface of said first end of said first side wall being positioned adjacent said first side of said first end wall;

said first end of said first side wall being selectively removably secured to said first side of said first end wall;

said inner surface of said second end of said first side wall being positioned adjacent said first side of said second end wall;

said second end of said first side wall being selectively removably secured to said first side of said second end wall;

a second upstanding rectangular side wall having upper and lower ends, first and second ends, an inner surface and an outer surface;

said inner surface of said lower end of said second side wall being positioned at said second side of said bottom;

said lower end of said second side wall being selectively removably secured to said second side of said bottom;

said first end of said second side wall being selectively removably secured to said second side of said first end wall;

said second end of said second side wall being selectively removably secured to said second side of said second end wall;

a third upstanding side wall having upper and lower ends, first and second ends, an inner surface and an outer surface;

said lower end of said third side wall being positioned adjacent said upper end of said second side wall;

said inner surface of said first end of said third side wall being positioned adjacent said second side of said first end wall;

said first end of said third side wall being selectively removably secured to said second side of said first end wall;

said inner surface of said second end of said third side wall being positioned adjacent said second side of said second end wall;

said second end of said third side wall being selectively removably secured to said second side of said second end wall;

a rectangular top having first and second ends, first and second sides, an upper surface and a lower surface;

said top being positioned on said upper ends of said first and second end walls and extending therebetween;

said top extending between said upper inner of said first and third side walls;

said first end of said top being selectively removably secured to said upper end of said first end wall;

said second end of said top being selectively removably secured to said upper end of said second end wall;

said upper end of said first side wall being selectively removably secured to said first side of said top;

said upper end of said third side wall being selectively removably secured to said second side of said top.

* * * * *